US008421718B2

(12) United States Patent
Kim et al.

(10) Patent No.: US 8,421,718 B2
(45) Date of Patent: Apr. 16, 2013

(54) ORGANIC LIGHT EMITTING DEVICE

(75) Inventors: Haksu Kim, Gumi (KR); Wonkyu Ha, Gumi (KR); Jaedo Lee, Gumi (KR); Kyoungdon Woo, Gumi (KR); Sujin Baek, Gumi (KR)

(73) Assignee: LG Display Co., Ltd., Seoul (KR)

( * ) Notice: Subject to any disclaimer, the term of this patent is extended or adjusted under 35 U.S.C. 154(b) by 1146 days.

(21) Appl. No.: 11/952,752

(22) Filed: Dec. 7, 2007

(65) Prior Publication Data

US 2008/0291135 A1 Nov. 27, 2008

(30) Foreign Application Priority Data

May 21, 2007 (KR) ..... 10-2007-0049389
Jun. 1, 2007 (KR) ..... 10-2007-0053730

(51) Int. Cl.

| | |
|---|---|
| ***G09G 3/30*** | (2006.01) |
| ***G09G 3/36*** | (2006.01) |
| ***G09G 5/10*** | (2006.01) |
| ***G09G 3/32*** | (2006.01) |
| ***G09G 3/10*** | (2006.01) |
| ***H01J 29/10*** | (2006.01) |

(52) U.S. Cl.

USPC ..... 345/77; 345/82; 345/102; 345/690; 313/463; 315/169.3

(58) Field of Classification Search ..... 345/30, 345/45, 76–78, 84, 87, 102, 690, 89, 204; 315/169.3; 313/463

See application file for complete search history.

(56) References Cited

U.S. PATENT DOCUMENTS

| | | | | |
|---|---|---|---|---|
| 2001/0055384 | A1 * | 12/2001 | Yamazaki et al. | 379/419 |
| 2002/0097252 | A1 * | 7/2002 | Hirohata | 345/690 |
| 2003/0179221 | A1 * | 9/2003 | Nitta et al. | 345/690 |
| 2003/0214521 | A1 * | 11/2003 | Osame et al. | 345/690 |
| 2005/0168490 | A1 * | 8/2005 | Takahara | 345/690 |
| 2008/0111835 | A1 * | 5/2008 | Hu | 345/690 |

* cited by examiner

*Primary Examiner* — Lun-Yi Lao
*Assistant Examiner* — Jarurat Suteerawongsa
(74) *Attorney, Agent, or Firm* — Morgan, Lewis & Bockius LLP

(57) ABSTRACT

An organic light emitting device is disclosed. The organic light emitting device includes a display unit including a plurality of subpixels, a host memory unit that stores image data received from the outside by the frame, a data adjusting unit that fetches the image data frames stored in the host memory unit by the bit and converts one frame into a plurality of subfields and one display memory unit that stores the image data frame converted into the plurality of subfields by the data adjusting unit. When the data adjusting unit converts the frame into the plurality of subfields, the data adjusting unit inserts a black time into at least one of the plurality of subfields.

8 Claims, 14 Drawing Sheets

ORGANIC LIGHT EMITTING DEVICE

This application claims the benefit of Korean Patent Application Nos. 10-2007-0049389 and 10-2007-0053730 filed on May 21, 2007 and Jun. 1, 2007, which are hereby incorporated by reference.

BACKGROUND OF THE DISCLOSURE

1. Field of the Disclosure

An exemplary embodiment relates to a display device, and more particularly, to an organic light emitting device.

2. Description of the Related Art

Among flat panel display devices, an organic light emitting device is a self-emission display device that does not require a backlight and has such characteristics that it can be formed to be light and thin, its process can be simplified, and it can be fabricated at a low temperature, has a high response speed of 1 ms or lower, a low power consumption, a wide viewing angle, and high contrast, etc.

The organic light emitting device may be classified into a top emission type device and a bottom emission type device depending on an emission direction of light, and also may be classified into a passive matrix type device and an active matrix type device depending on a driving method.

The active matrix type device is operated such that when a scan signal and a data signal are supplied to a plurality of subpixels arranged in a matrix format on a display unit, transistors, capacitors, and organic light emitting diodes (OLEDs) positioned in each subpixel are driven to display an image.

The OLED device receives the data and scan signals from devices positioned at an outer side of a panel. Here, the image data received from the outside is stored in a host memory, undergoes a picture quality tuning process, is arranged by the frame, and is then supplied to the display unit.

In order to supply data signals by the frame, the data stored in the host memory is fetched (called or retrieved) by the bit through time division controlling. At this time, data to be currently supplied and data to be supplied next are discriminated, and in order to continuously read and write them, two or more display memories are generally and necessarily used.

The reason for using the two or more display memories is because, while reading data from the memory by supplying corresponding data to the display unit, new data cannot be written in the display memory unit, in terms of the arrangement structure of the subfields.

Thus, the driving method that necessarily uses the two or more display memories causes a loss of costs.

In order to avoid a problem of degradation of elements such as the TFT, the capacitor or the OLED, etc., monitor pixels are provided on a substrate at an outer side of the display unit, and power supplied to the subpixels positioned within the display unit is sampled and controlled according to the sampled value to thus compensate changed characteristics of the subpixels.

In this case, for a sample hold unit that samples the power supplied to the monitor pixels, it is important to consider driving conditions between interworking elements such as a writing or reading process of a display memory unit or a light emitting period or a non-emitting period of the subpixels.

Thus, in order to properly compensate the changed characteristics of the subpixels by using the monitor pixels and the sample hold unit, a method that may increase the efficiency and accuracy of sampling in consideration of the above-mentioned conditions is required.

SUMMARY OF THE DISCLOSURE

Exemplary embodiments provide an organic light emitting device capable of increasing the efficiency of data transmission by reducing the number of display memory units.

Exemplary embodiments provide an organic light emitting device capable of increasing the sampling efficiency and the sampling accuracy of monitor pixels.

In one aspect, an organic light emitting device includes a display unit including a plurality of subpixels, a host memory unit that stores image data received from the outside by the frame, a data adjusting unit that fetches the image data frames stored in the host memory unit by the bit and converts one frame into a plurality of subfields and one display memory unit that stores the image data frame converted into the plurality of subfields by the data adjusting unit. When the data adjusting unit converts the frame into the plurality of subfields, the data adjusting unit inserts a black time into at least one of the plurality of subfields.

In another aspect, an organic light emitting device includes a display unit including a plurality of subpixels, one or more monitor pixels positioned to correspond to an emission color of the subpixels on a substrate positioned outside the display unit, a power supply unit that supplies a voltage or a current to the subpixels and the monitor pixels, a host memory unit that stores image data received from the outside by the frame, a data adjusting unit that fetches the image data frames stored in the host memory unit by the bit and converts one frame into a plurality of subfields, one display memory unit that stores the image data frame converted into the plurality of subfields by the data adjusting unit and a sample hold unit that samples a current supplied to the monitor pixels and transfers the sampled current to the power supply unit to thus control a voltage supplied to the subpixels, wherein when a writing operation is performed for the data adjusting unit to store the plurality of subfields in the display memory unit, the sample hold unit samples the current supplied to the monitor pixels.

In yet another aspect, an organic light emitting device includes a display unit including a plurality of subpixels, one or more monitor pixels positioned to correspond to an emission color of the subpixels on a substrate positioned outside the display unit, a power supply unit that supplies a voltage or a current to the subpixels and the monitor pixels, a host memory unit that stores image data received from the outside by the frame, a data adjusting unit that fetches the image data frames stored in the host memory unit by the bit and converts one frame into a plurality of subfields, one display memory unit that stores the image data frame converted into the plurality of subfields by the data adjusting unit and a sample hold unit that samples a current supplied to the monitor pixels and transfers the sampled current to the power supply unit to thus control a voltage supplied to the subpixels, wherein when a writing operation is performed for the data adjusting unit to store the plurality of subfields in the display memory unit, the sample hold unit samples the current supplied to the monitor pixels, and the plurality of subfields each include an emitting layer, and at least one of the emitting layers includes a phosphorescence material.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
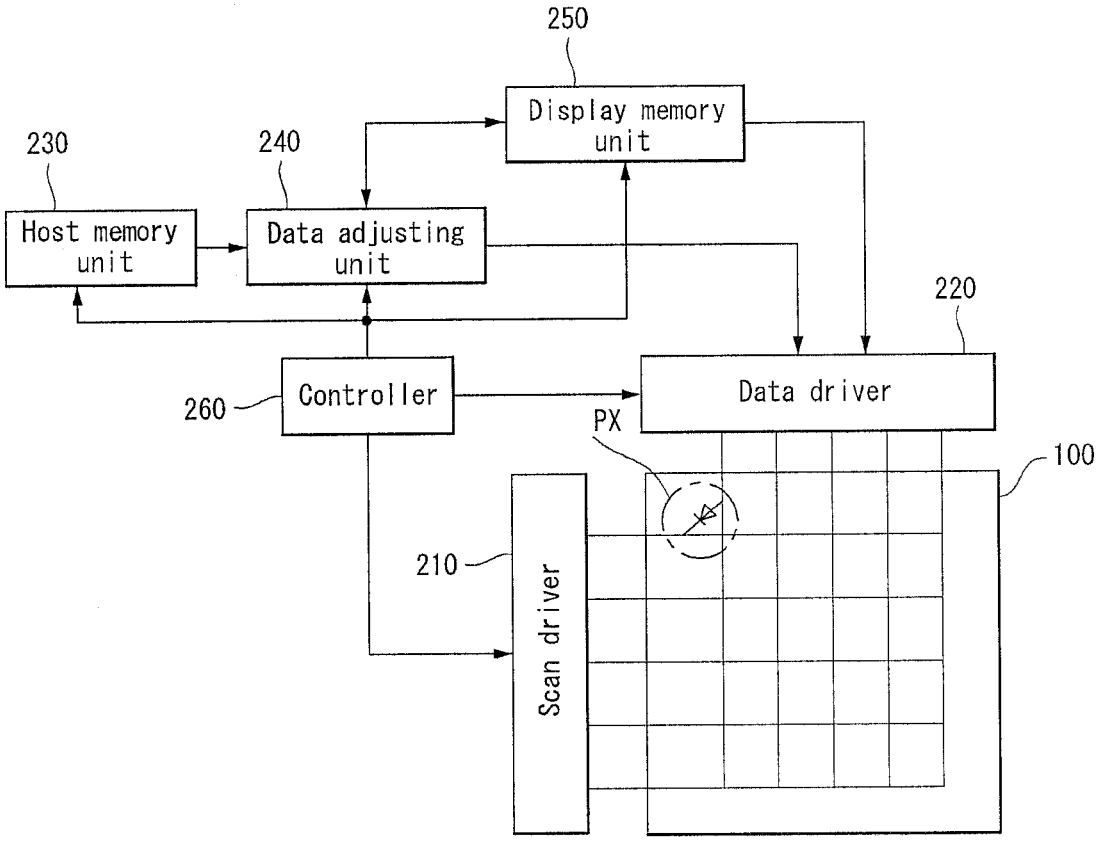
FIG. 1 is a schematic block diagram of an organic light emitting device according to an exemplary embodiment.

FIG. 1 is a schematic block diagram of an organic light emitting device according to an exemplary embodiment.

As shown in FIG. 1, the organic light emitting device according to the exemplary embodiment comprises a display unit 100 including a plurality of subpixels PX arranged in a matrix format on a substrate.

The organic light emitting device comprises drivers 210 and 220 that supply a data signal and a scan signal to the display unit 100. The drivers 210 and 220 may include a data driver 220 that supplies a data signal to the display unit 100 and a scan driver 210 that supplies a scan signal to the display unit 100.

The organic light emitting device comprises a host memory unit 230 that stores image data received from the outside, by the frame. The host memory unit 230 may be formed as a large capacity storage unit that can store a huge amount of image data from the outside.

The organic light emitting device comprises a display memory unit 250 that stores the image data frames stored in the host memory unit 230, by the subfield, and supplies them to the data driver 220.

The organic light emitting device comprises a data adjusting unit 240 that fetches (calls or retrieves) the image data frame stored in the host memory unit 230 by the bit, converts the image data frame into a plurality of subfields, and stores them in the display memory unit 250.

In particular, when the data adjusting unit 240 stores the image data frame in the display memory unit 250 after converting it into the plurality of subfields, it adds one or more subfields into one frame and inserts a black time into the added subfields.

The organic light emitting device comprises a controller 260 that supplies a control signal to the host memory unit 230, the data adjusting unit 240, the display memory unit 250, the drivers 210 and 220, etc. The controller 260 generates the control signal to allow the respective elements to interwork and be controlled mutually organically.

Figure 2A:
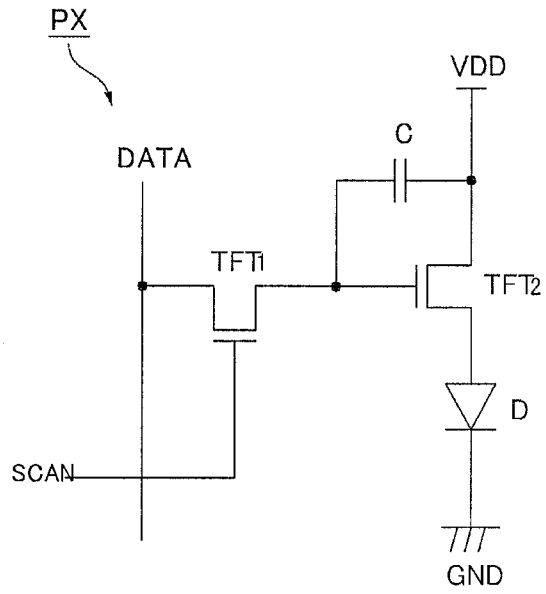
FIGS. 2A and 2B are views illustrating a circuit configuration of a subpixel of the organic light emitting device according to the exemplary embodiment.
Figure 2B:
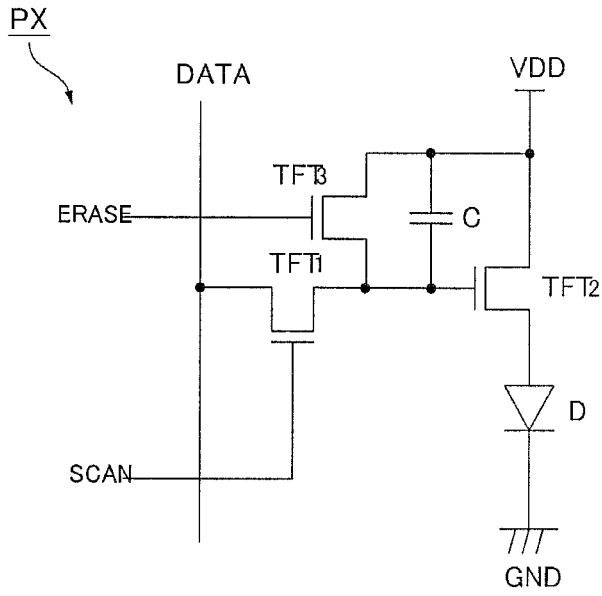

FIGS. 2A and 2B are views illustrating a circuit configuration of a subpixel of the organic light emitting device according to the exemplary embodiment.

As shown in FIG. 2A, the subpixel PX comprises a switching transistor TFT1 having a gate connected with a scan line SCAN and a first electrode commonly connected with a data line DATA.

The subpixel PX comprises a driving transistor TFT2 having a gate connected with a second electrode of the switching transistor TFT1 and a first electrode connected with a first power supply line VDD.

The subpixel PX comprises a capacitor (C) connected between the gate of the driving transistor TFT2 and the first power supply line VDD. The subpixel PX comprises an organic light emitting diode (OLED) (D) connected between a second electrode of the driving transistor TFT2 and a second power supply line GND.

The subpixel PX shown in FIG. 2B has a similar circuit construction to that of the subpixel PX shown in FIG. 2A except that it further comprises an erasing transistor TFT3 for erasing a data voltage remaining in the capacitor (C) through the data line DATA. The erasing transistor TFT3 receives an erase signal through an erase signal line ERASE.

In such circuit construction of the subpixels, the OLED (D) may comprises an emitting layer formed as an organic layer, but the emitting layer may be formed as an inorganic layer to constitute an inorganic light emitting diode.

Here, the OLED (D) comprises an organic emitting layer (EML) between common layers such as a hole injection layer (HIL), a hole transport layer (HTL), an electron transport layer (ETL), and an electron injection layer (EIL). In general, the common layer is selectively formed between the first electrode (pixel electrode), serving as an anode electrode, and a cathode electrode of the driving transistor TFT2.

Power supply lines of each subpixel may be discriminately connected with the power supply unit and receive respectively independent voltages, namely, mutually different voltages. The transistors included in each subpixel may be driven in a linear region or in a saturation region by a drive signal supplied from the drivers.

A difference between driving voltages, e.g., the power voltages VDD and Vss of the organic light emitting device may change depending on the size of the display unit 100 and a driving manner. A magnitude of the driving voltage is shown in the following Tables 1 and 2. Table 1 indicates a driving voltage magnitude in case of a digital driving manner, and Table 2 indicates a driving voltage magnitude in case of an analog driving manner.

TABLE 1

| Size (S) of display panel | VDD-Vss (R) | VDD-Vss (G) | VDD-Vss (B) |
|---|---|---|---|
| S < 3 inches | 3.5-10 (V) | 3.5-10 (V) | 3.5-12 (V) |
| 3 inches < S < 20 inches | 5-15 (V) | 5-15 (V) | 5-20 (V) |
| 20 inches < S | 5-20 (V) | 5-20 (V) | 5-25 (V) |

TABLE 2

| Size (S) of display panel | VDD-Vss (R, G, B) |
|---|---|
| S < 3 inches | 4~20 (V) |
| 3 inches < S < 20 inches | 5~25 (V) |
| 20 inches < S | 5~30 (V) |

Figure 3:
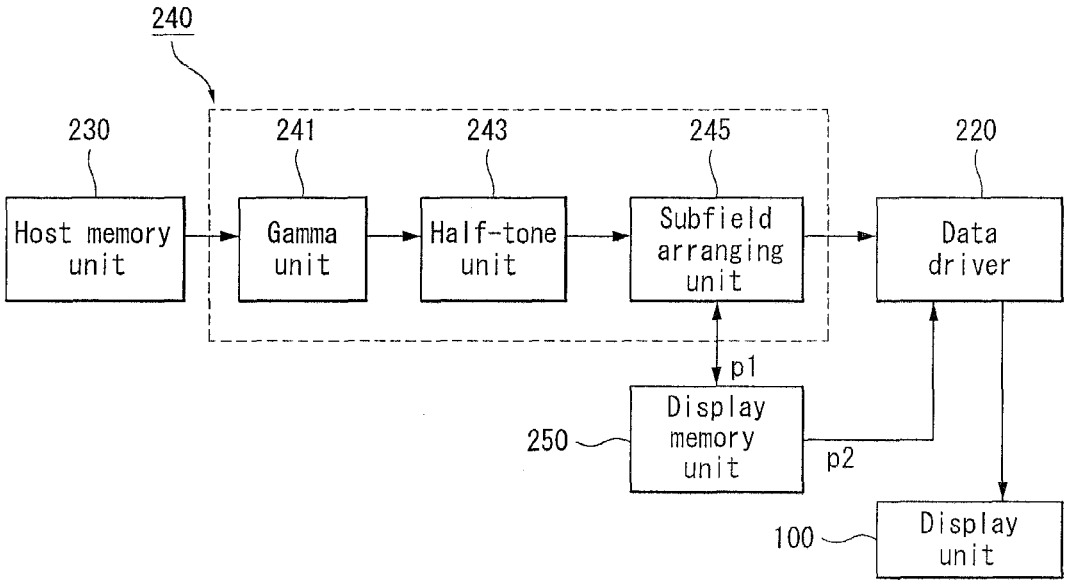
FIG. 3 is a view illustrating a configuration of a data adjusting unit of the organic light emitting device according to the exemplary embodiment.
Figure 4:
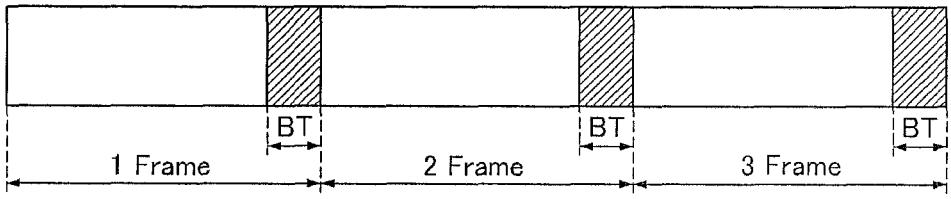
FIG. 4 is a view illustrating an example of a subfield into which a black time is inserted.

FIG. 3 is a view illustrating a configuration of a data adjusting unit of the organic light emitting device according to the exemplary embodiment. FIG. 4 is a view illustrating an example of a subfield into which a black time is inserted.

As shown in FIG. 3, the data adjusting unit 240 comprises a gamma unit 241, a half-tone unit 243, and a subfield arranging unit 245.

The gamma unit 241 fetches the image data frames stored in the host memory unit 230 by the bit, and converts luminance values of red (R), green (G), and blue (B) image data frames previously stored in and inputted from a gamma data conversion system into gray scales suitable for displaying an image of the organic light emitting device.

In performing gamma conversion, the gamma unit 241 converts the inputted image data frames into a plurality of subfields based on data corresponding to the inputted image data frames by using an internal look-up table included therein, and in this case, the gamma unit 251 may add one or more subfields and insert a black time into the added subfields.

Here, the added subfields may be positioned at a head portion or at an end portion of one frame, and in the exemplary embodiment, a description will be made by taking an example that the added subfield having the black time is positioned at the end portion of the frame.

As shown in FIG. 4, one image data frame divided into a plurality of subfields may have a block time BT at a subfield positioned at an end portion of the frame.

The half-tone unit 243 performs image dithering in order to finely (minutely) adjusting the data in units of subfields which has been gamma-converted by the gamma unit 241, namely, an image which has been converted into subfields.

The subfield arranging unit 245 arranges the data in units of subfields with the black time inserted therein such that it can be stored in the display memory unit 250, and re-arranges the data in units of subfields as stored in the display memory unit 250 such that it can be supplied to the display unit 100 through the data driver 220.

Here, the process of re-arranging the data in units of subfields may be required according to a required output condition of the data driver 220. Accordingly, the data signal stored in the display memory unit 250 may be transferred to the data driver 220 via the subfield arranging unit 245 along a first path p1 or may be transferred to the data driver 220 along a second path p2 without passing through the subfield arranging unit 245.

The thusly arranged data in units of subfields is stored in the display memory unit 250 and then supplied to the display unit 100 through the data driver 220. Then, the display unit 100 displays an image according to the received signals.

In this process, the display memory unit 250 alternately performs a writing process of fetching the image data frames stored in the host memory unit 230 by the bit by means of the data adjusting unit 240 and storing them in units of a plurality of subfields, and a reading process of reading the subfields stored in the display memory unit 250 by means of the data driver 220.

When the look-up table fetches the image data frame by the bit from the host memory unit 230, it may fetch the image data frame by extending the bit unit. In other words, the look-up table may fetch the image data frame in units of 6 bits, or in units of more than 8 bits in order to increase the number of subfields.

When the image data frame is stored by more than 8 bits in the display memory unit 250, the subfield may be divided into 28 or more subfields and stored. In this manner, the number of subfields can be increased and the black time is inserted into the extended subfields, to thus prevent a phenomenon the subfields overlap with subfields stored next time in the display memory unit 250. This obtains an effect that a discrimination region can be provided between current data and next data.

When the number of subfields is increased in written or read from the display memory unit 250, a high frequency may be used.

The subfields converted by the data adjusting unit 240 will be described in more detail with reference to FIG. 5 as follows.

Figure 5:
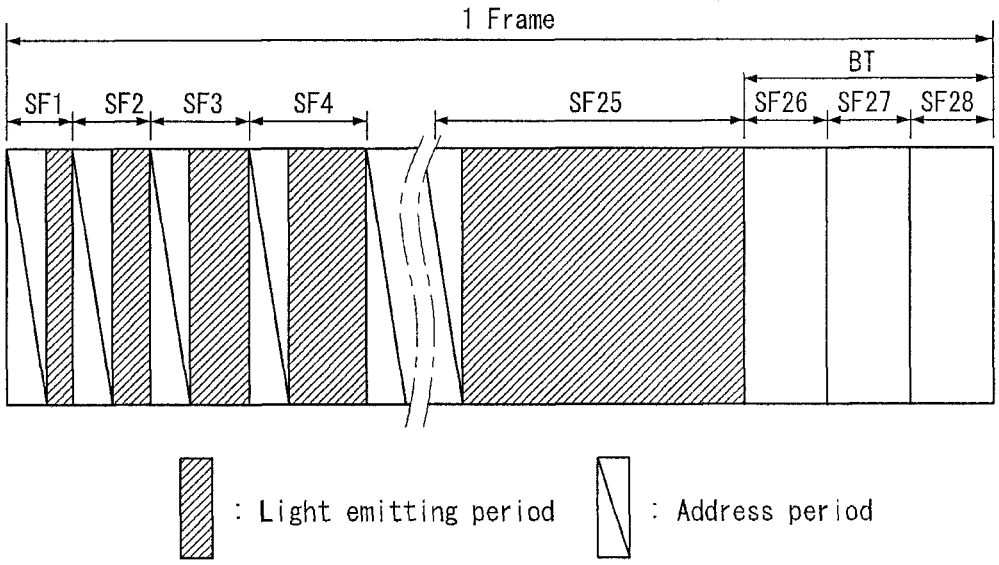
FIG. 5 is a view illustrating an example of a data frame converted in each of a plurality of subfields.

FIG. 5 is a view illustrating an example of a data frame converted in each of a plurality of subfields.

As shown in FIG. 5, one image data frame (1 frame) may be divided into a plurality of subfields, e.g., into 28 subfields (SF1 to SF28). Some (SF1 to SF25) of the subfields each are divided into an address period and a light emitting period. Subfields (e.g., SF26 to SF28) positioned at an end portion of the frame may have a black time inserted therein, respectively.

Regarding the data frame converted into the a plurality of subfields, when a scan signal is supplied to the address period of one subfield, a subpixel to be illuminated is selected, and when a data signal is supplied to the selected subfixel, the OLED (D) emits light.

The light emitting period determines gray level weight of each subfield. For example, in such a method of setting gray level weight of a first subfield SF1 to $2^0$ and gray level weight of a second subfield SF2 to $2^1$, gray level weight of each subfield increases in a rate of $2^n$ (where, n=0, 1, 2, 3, 4, 5).

In this manner, in the light emitting period of each subfield, an emission maintaining time of each subfield can be controlled according to the gray scale weight value to represent gray scales with respect to various images.

For reference, because an emission time of the least significant bit (LSB) of the subfields is so short that an erase period may be inserted to erase the emission time, during the erase period, light emission of the OLED can be prevented by discharging the data signal stored in the capacitor of the subpixel. Unlike the case as shown in FIG. 5, the subfield with the erase period has the structure of an address period, a light emitting period and an erase period.

Meanwhile, the black time BT inserted in the subfield positioned at the end portion of the frame does not express an image unlike the display period during which the address period and the light emitting period are provided.

Accordingly, the length of the period of the subfields with the black time BT inserted at the end portion of the frame may be set to have the length within the range of about 3% to 30% of the total length of one frame section. Here, an ideal length of the subfield section with the black time BT inserted may lie substantially in a range between 5% and 15%.

That is, when the length of the subfield section with the black time BT is 3% or greater than one frame section, data can be sufficiently written in a sub-memory, and when the length of the subfield section with the black time BT is 30% or smaller, occurrence of a flicker phenomenon can be prevented.

When the length of the subfield section with the black time BT is within the range of about 5% to 15% of one frame section, reading and writing operations can be performed at a fast frequency clock in accessing the display memory.

When one frame comprises 28 subfields, substantially one to nine subfields may have black time BT, and preferably, substantially one to four subfields have the black time BT.

The subfields may be arranged such that positions of the least significant bit (LSB) and the most significant bit (MSB) are mixed at more than some parts.

Figure 6A:
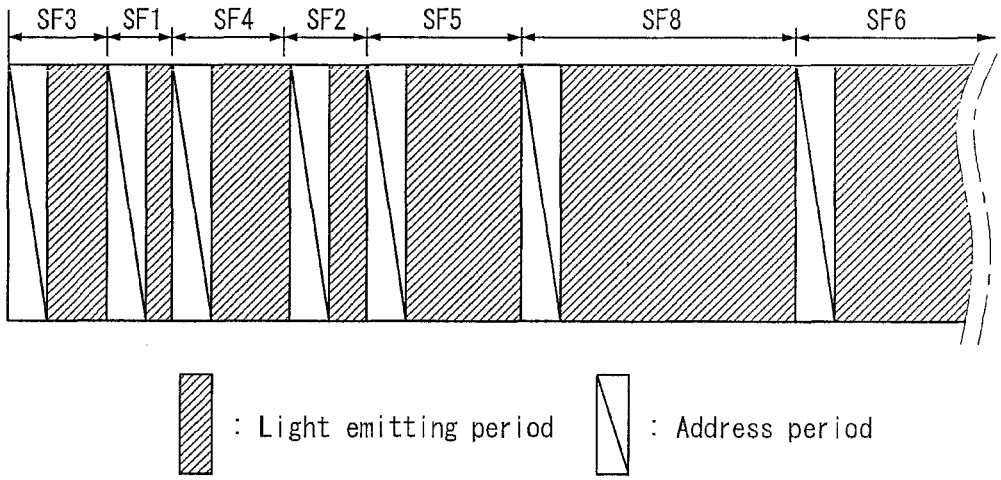
FIGS. 6A and 6B are views illustrating another example of a data frame adjusted by in each of a plurality of subfields.
Figure 6B:
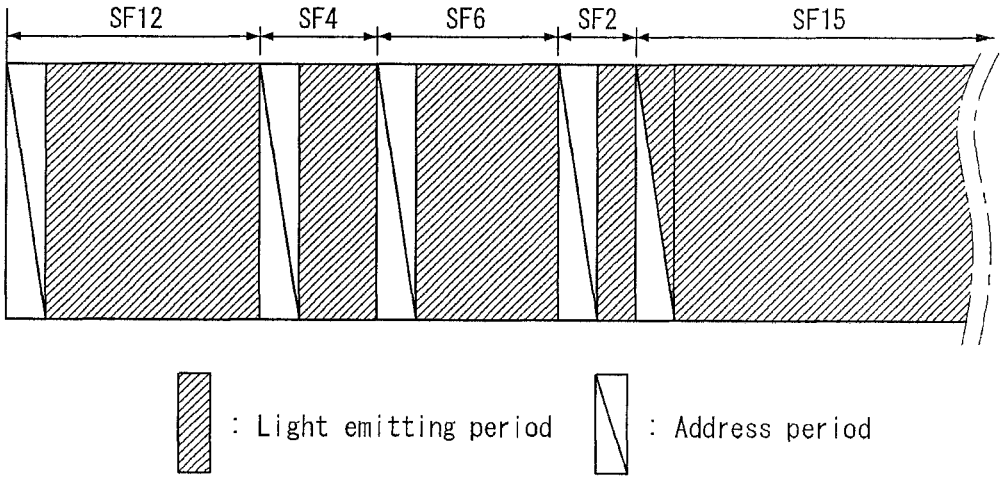

FIGS. 6A and 6B are views illustrating another example of a data frame adjusted by in each of a plurality of subfields.

As shown in FIGS. 6A and 6B, when the image data frame (one frame) is divided into a plurality of subfields, the subfields may be arranged such that the positions of the LSB and the MSB are mixed at more than some parts. This is because as the light emitting period of the subfields is lengthened as it comes later, the center of light is inclined to a particular region.

That is, when the MSB of data that first arrives emits light long and data that comes next emits light short, visual sensation would be degraded. Thus, in order to avoid this phenomenon, the subfields would be better to be arranged variably.

In addition, the subfields may be arranged such that the MSB is positioned at a section adjacent to the LSB or the LSB is positioned at a section adjacent to the MSB, so that the center of light can be uniformly distributed to the entire sections.

Figure 7:
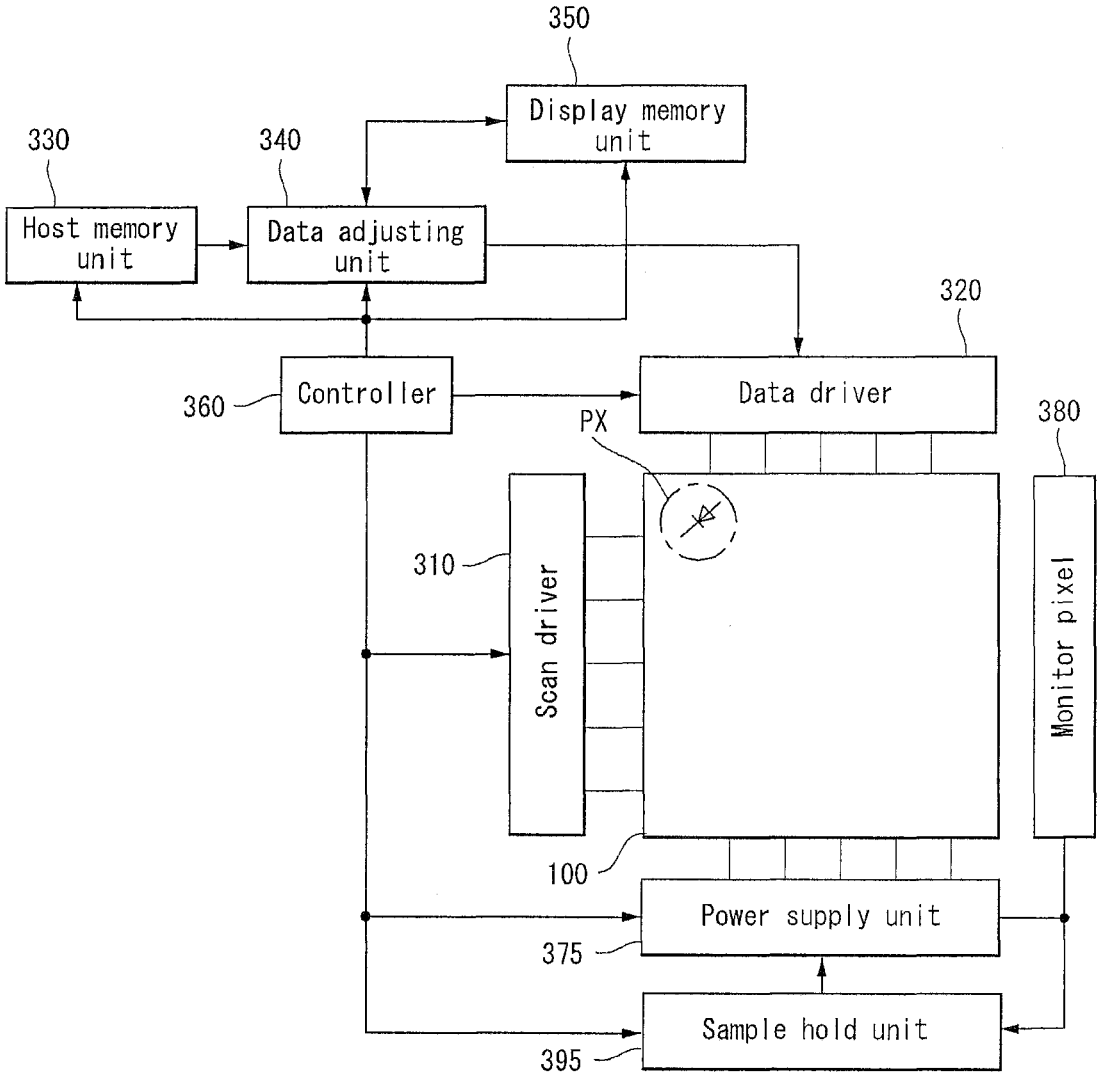
FIG. 7 is a schematic block diagram of an organic light emitting device according to another exemplary embodiment.

FIG. 7 is a schematic block diagram of an organic light emitting device according to another exemplary embodiment.

As shown in FIG. 7, the organic light emitting device according to another exemplary embodiment comprises a display unit 100 including a plurality of subpixels PX arranged in a matrix format on a substrate. Supposing that red, green and blue light is emitted in the subpixels PX.

The organic light emitting device comprises monitor pixels 380 positioned to correspond to an emission color of the subpixels PX on the substrate at an outer side of the display unit 100. The monitor pixels 380 are positioned to correspond to an emission color of the subpixels PX, so an example will be taken with the monitor pixels 380 emitting light in red, green, and blue colors.

The organic light emitting device comprises a power supply unit 375 that supplies voltage to the subpixels PX and current to the monitor pixels 380. The power supply unit 375 may employ one of a method in which current outputted from a current source is supplied to all the monitor pixels 380 and a method in which current outputted from three current sources which correspond to the monitor pixels 380 is supplied to the respective monitor pixels 380.

The organic light emitting device comprises drivers 310 and 320 that supply a data signal and a scan signal to the display unit 100. The drivers 310 and 320 may include a data driver 320 that supplies a data signal to the display unit 100 and a scan driver 310 that supplies a scan signal to the display unit 100.

The organic light emitting device comprises a host memory unit 330 that stores image data received from the outside, by the frame. The host memory unit 330 may be formed as a large capacity storage unit that can store a huge amount of image data from the outside.

The organic light emitting device comprises a display memory unit 350 that stores the image data frames stored in the host memory unit 140, by the subfield, and supplies them to the data driver 320.

The organic light emitting device comprises a data adjusting unit 340 that fetches the image data frame stored in the host memory unit 330 by the bit, converts the image data frame into a plurality of subfields, and stores them in the display memory unit 350.

In particular, when the data adjusting unit 340 stores the image data frame in the display memory unit 350 after converting it into the a plurality of subfields, it adds one or more subfields into one frame and inserts a black time into the added subfields.

The organic light emitting device comprises a sample hold unit 395 that samples the current supplied to the monitor pixels 380 and transfers the sampled value to the power supply unit 375 to thus control the voltage supplied to the subpixels PX. Here, when a writing operation is performed for the data adjusting unit to store the a plurality of subfields in the display memory unit 350, the sample hold unit 395 samples the current supplied to the monitor pixels 380.

The organic light emitting device comprises a controller 360 that supplies a control signal to the host memory unit 330, the data adjusting unit 340, the display memory unit 350, the drivers 310 and 320, the power supply unit 375, the sample hold unit 395, etc. The controller 360 generates the control signal to allow the respective elements to interwork and be controlled mutually organically.

Figure 8:
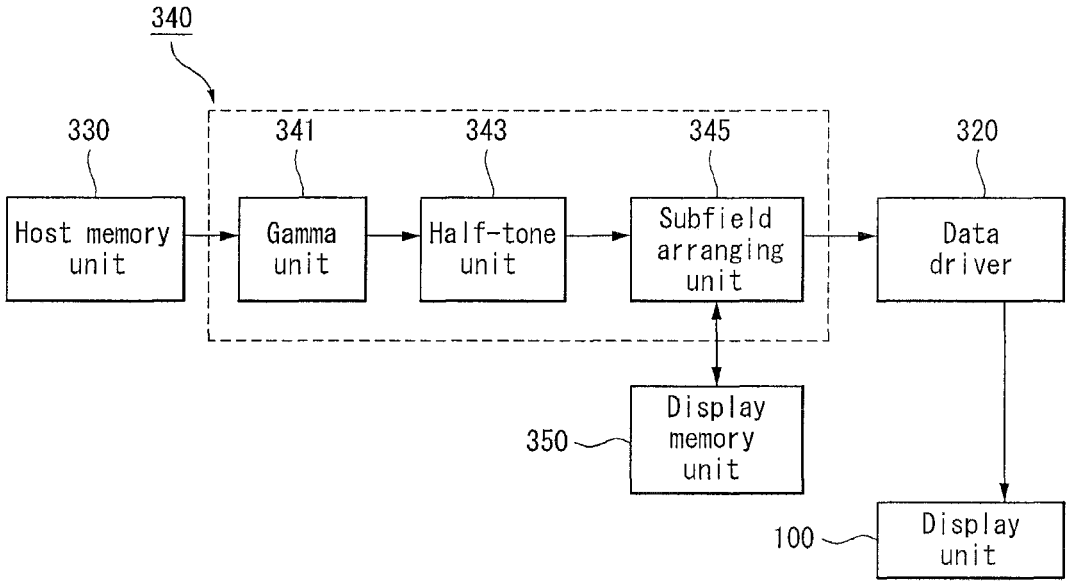
FIG. 8 is a view illustrating a configuration of a data adjusting unit of the organic light emitting device according to another exemplary embodiment.

FIG. 8 is a view illustrating a configuration of a data adjusting unit of the organic light emitting device according to another exemplary embodiment.

As shown in FIG. 8, the data adjusting unit 340 comprises a gamma unit 341, a half-tone unit 343, and a subfield arranging unit 345.

The gamma unit 341 fetches the image data frames stored in the host memory unit 140 by the bit, and converts luminance values of red (R), green (G), and blue (B) image data frames previously stored in and inputted from a gamma data conversion system into gray scales suitable for displaying an image of the organic light emitting device.

In performing gamma conversion, the gamma unit 341 converts the inputted image data frames into a plurality of subfields based on data corresponding to the inputted image data frames by using an internal look-up table included therein, and in this case, the gamma unit 341 may add one or more subfields and insert a black time into the added subfields.

Here, the added subfields may be positioned at a head portion or at an end portion of the frame, and in another exemplary embodiment, a description will be made by taking an example that the added subfield having the black time is positioned at the end portion of the frame.

The half-tone unit 343 performs image dithering in order to finely (minutely) adjusting the data in units of subfields which has been gamma-converted by the gamma unit 341, namely, an image which has been converted into subfields.

The subfield arranging unit 345 arranges the data in units of subfields with the black time inserted therein such that it can be stored in the display memory unit 350, and re-arranges the data in units of subfields as stored in the display memory unit 350 such that it can be supplied to the display unit 100 through the data driver 320.

Here, the process of re-arranging the data in units of subfields may be required according to a required output condition of the data driver 320.

The thusly arranged data in units of subfields is stored in the display memory unit 350 and then supplied to the display unit 100 through the data driver 320. Then, the display unit 100 displays an image according to the received signals.

In this process, the display memory unit 350 alternately performs a writing process of fetching the image data frames stored in the host memory unit 330 by the bit by means of the data adjusting unit 340 and storing them in units of a plurality of subfields, and a reading process of reading the subfields stored in the display memory unit 350 by means of the data driver 320.

When the look-up table fetches the image data frame by the bit from the host memory unit 330, it may fetch the image data frame by extending the bit unit. In other words, the look-up table may fetch the image data frame in units of 6 bits, or in units of more than 8 bits in order to increase the number of subfields.

When the image data frame is stored by more than 8 bits in the display memory unit 350, the subfield may be divided into 28 or more subfields and stored. In this manner, the number of subfields can be increased and the black time is inserted into the extended subfields, to thus prevent a phenomenon the subfields overlap with subfields stored next time in the display memory unit 350. This obtains an effect that a discrimination region can be provided between current data and next data.

When the number of subfields is increased and written in or read from the display memory unit 160, a high frequency may be used.

Figure 9:
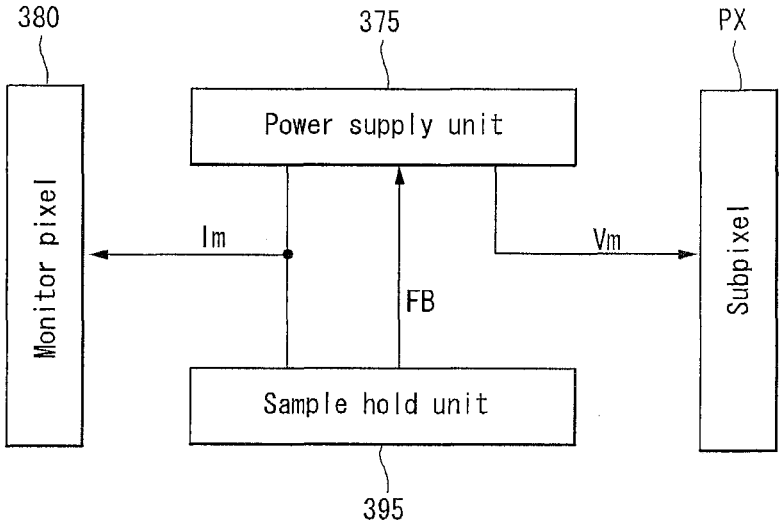
FIG. 9 is a block diagram of a sample hold unit of the organic light emitting device according to another exemplary embodiment.

FIG. 9 is a block diagram of a sample hold unit of the organic light emitting device according to another exemplary embodiment.

As shown in FIG. 9, when the power supply unit 375 supplies current to the monitor pixels 380, the sample hold unit 395 samples the supplied current Im with voltage and transfers a sampled value as a feedback signal FB to the power supply unit 375.

Then, the power supply unit 375 controls the voltage Vm to be supplied to the subpixels PX with reference to the sampled value.

In order to sample the current Im supplied to the monitor pixels 380 with the voltage and transfer the sampled value to the power supply unit 375, the sample hold unit 395 may comprise two or more switch units, one or more capacitors, and one or more amplifies.

That is, one of the two or more switch units of the sample hold unit 395 is positioned at a power supply line connecting the power supply unit 375 to the monitor pixels 380 to perform a switching operation to supply the current Im to the monitor pixels 380.

The other of the two or more switch units of the sample hold unit 395 is connected with a power supply line of the monitor pixels to sample the current Im supplied to the monitor pixels 380. At this time, the sampled current Im is held as voltage to the capacitor and the held voltage is transferred as the feedback signal FB to the power supply unit 375 after passing through the amplifier. Then, the power supply unit 375 controls the voltage to be supplied to the subpixels PX with reference to the feedback signal FB.

In another exemplary embodiment, the sample hold unit of the organic light emitting device may sample current supplied to the monitor pixels when the data adjusting unit performs a writing operation to store a plurality of subfields in the display memory unit.

Figure 10:
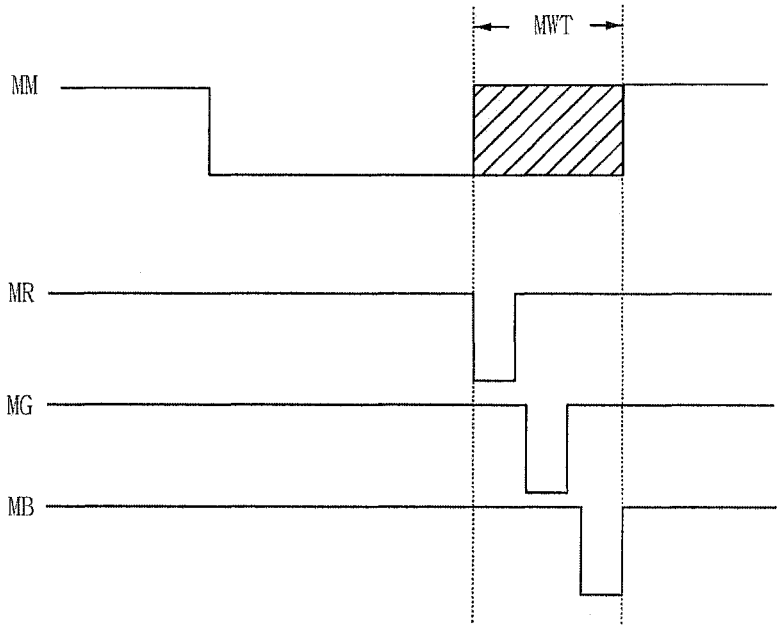
FIG. 10 is a view illustrating an example of driving waveforms according to a sampling operation of a sample hold unit in association with a writing process of a display memory unit.

FIG. 10 is a view illustrating an example of driving waveforms according to a sampling operation of a sample hold unit in association with a writing process of a display memory unit.

The sampling driving waveforms as shown in FIG. 10 are obtained when it is assumed that a current source is included in the power supply unit.

As shown in FIG. 10, during a memory writing time (NWT) while the display memory unit (MM) performs a writing operation, the sample hold unit discriminately samples a red monitor pixel MR, a green monitor pixel MG, and a blue monitor pixel MB.

That is, when a current source is included in the power supply unit, the current source should perform time division switching or use a current distributor in order to supply each different current to the respective monitor pixels MR, MG, and MB. Thus, the sample hold unit discriminately samples the monitor pixels MR, MG, and MB.

Figure 11:
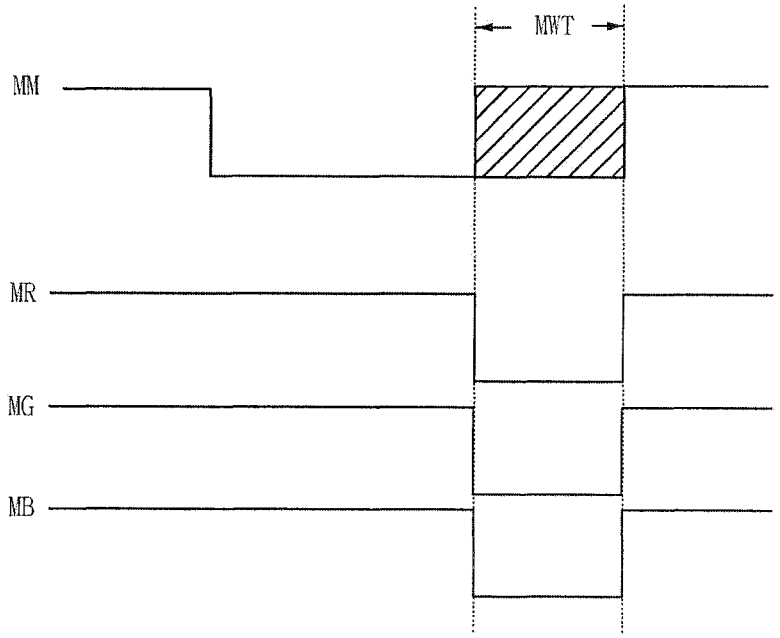
FIG. 11 is a view illustrating another example of driving waveforms according to a sampling operation of a sample hold unit in association with a writing process of the display memory unit.

FIG. 11 is a view illustrating another example of driving waveforms according to a sampling operation of a sample hold unit in association with a writing process of the display memory unit.

Specifically, FIG. 11 shows the sampling driving waveforms when three current sources are included in the power supply unit.

As shown in FIG. 11, during the memory writing time MWT while the display memory unit MM performs the writing operation, the sample hold unit samples all the red monitor pixel MR, the green monitor pixel MG, and the blue monitor pixel MB at the same period.

That is, when the current sources of the power supply unit correspond to the number of monitor pixels, the three current sources can supply each different current to the monitor pixels MR, MG, and MB during the same time period. Thus, the sample hold unit performs sampling during the same period.

The sampling method as shown in FIGS. 10 and 11 obtain the different sampling waves depending on whether only one current source is provided or whether the current sources are positioned to correspond to the number of the monitor pixels, but their eventual purposes are to acquire accurate sample values when current is supplied to the monitor pixels.

The writing process to store the plurality of subfields in the display memory unit is performed for a very short time, which, however, corresponds to a non-display state (period) during which the display unit does not display any image.

Accordingly, when the sample hold unit samples the current supplied to the monitor pixels, an error related to sample acquiring caused by a phenomenon that the ground at the second power supply line GND of the display device is shaken overall as it overlaps with the period during which the display unit displays an image, can be prevented That is, when the display unit is illuminated, the capacitor included in the sample hold unit is free from the error of acquiring a low sample value as the ground voltage is increased.

The problem results from the fact that all the second power supply lines GND in the display device are commonly grouped, which, anyhow, can be structurally solved. But when the problem is solved by using the driving method according to the present invention, such effects that the number of display memories required for driving in units of subfields is reduced and the sampling efficiency and accuracy of the monitor pixels is increased can be obtained.

Meanwhile, in the organic light emitting device according to another exemplary embodiment, when the data adjusting unit performs writing to store the plurality of subfields in the display memory unit, the current supplied to the monitor pixels is sampled. Here, in particular, some of the subfields have the black time, and the display unit is in a non-display state during the period while the subfields with the black time are supplied.

Thus, the period during which the sample hold unit performs sampling may be not only the period during which the display memory unit performs the writing operation but also the period during which the black time is provided.

In the following description with reference to FIGS. 12 and 13, the black time is inserted to some of the subfields of each frame and sampling is performed at every 'n' number of frames. In particular, the sampling of the current supplied to the monitor pixels is performed in case where only a current source is included in the power supply unit and in case where three current sources are included in the power supply unit.

Figure 12:
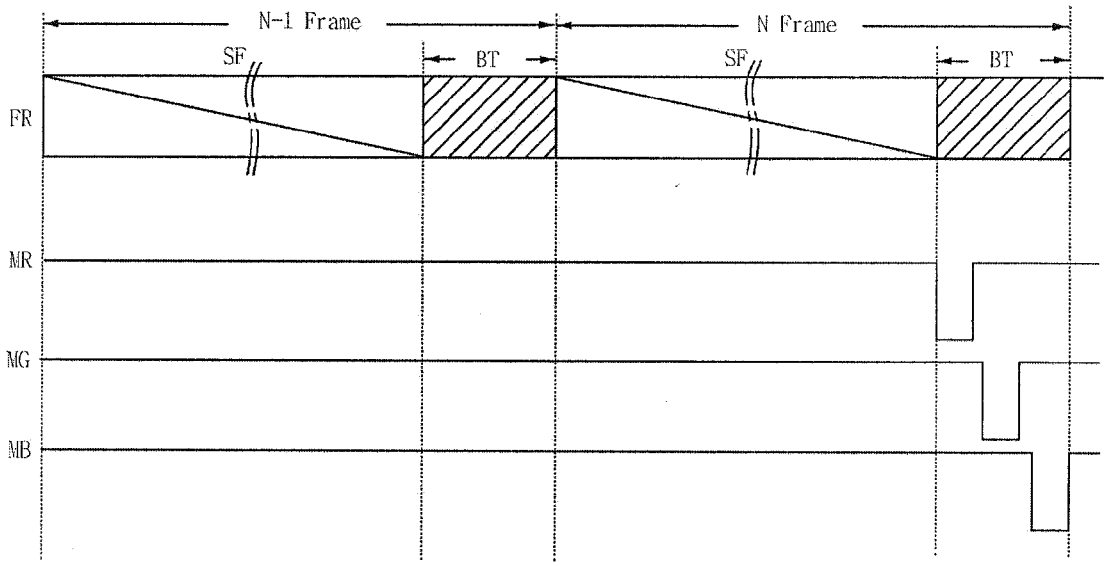
FIG. 12 is a view illustrating an example of driving waveforms according to a sampling operation of a sample hold unit in association with a subfield with a black time inserted.

FIG. 12 is a view illustrating an example of driving waveforms according to a sampling operation of a sample hold unit in association with a subfield with a black time inserted.

The sampling driving waveforms as shown in FIG. 12 are obtained when it is assumed that only a current source is included in the power supply unit.

As shown in FIG. 12, in the subfields with the black time positioned at the end portion of the final frame (N frame) among the two consecutive ones of the a plurality of frames FR comprising the a plurality of subfields SF and the subfields with the black time inserted, the sample hold unit discriminately samples the red monitor pixel MR, the green monitor pixel MG, and the blue monitor pixel MB.

Namely, the sample hold unit samples the current of the monitor pixels at the black time section positioned at the end of every two or more frames (N-1 frame and N frame). In this case, the present invention can be also applicable when three current sources are provided.

Figure 13:
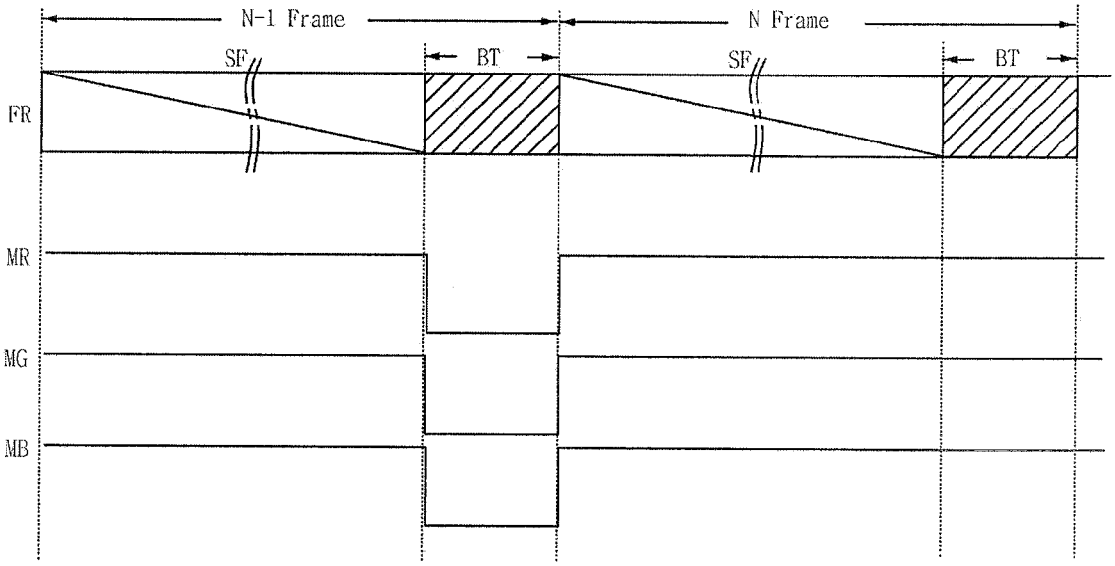
FIG. 13 is a view illustrating another example of driving waveforms according to a sampling operation of a sample hold unit in association with a subfield with a black time inserted.

FIG. 13 is a view illustrating another example of driving waveforms according to a sampling operation of a sample hold unit in association with a subfield with a black time inserted.

The sampling driving waveforms as shown in FIG. 13 are obtained when it is assumed that three current sources are included in the power supply unit.

As shown in FIG. 13, it is noted that, in the subfields with the black time positioned between the two consecutive ones of the a plurality of frames FR comprising the a plurality of subfields SF and the subfields with the black time inserted, the sample hold unit samples all the red monitor pixel MR, the green monitor pixel MG, and the blue monitor pixel MB during the same period.

Namely, the sample hold unit samples the current of the monitor pixels at the black time section positioned at the end of every frame (N−1 frame and N frame). In this case, the present invention can be also applicable when only a current source is provided.

Figure 14:
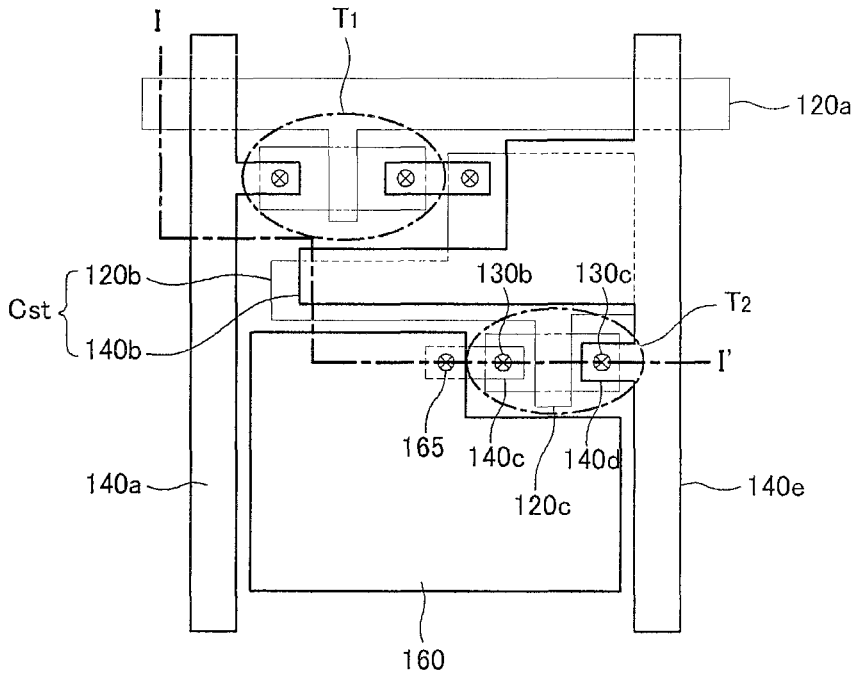
FIG. 14 is a plane view of the organic light emitting device according to the exemplary embodiments.
Figure 15A:
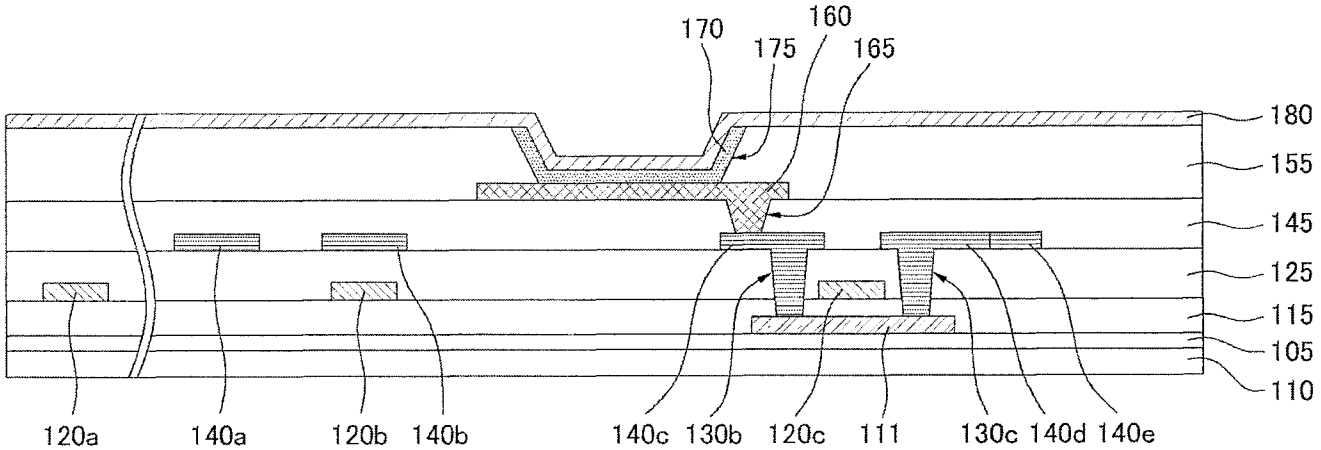
FIGS. 15A and 15B are cross-sectional views taken along line I-I' of FIG. 14.
Figure 15B:
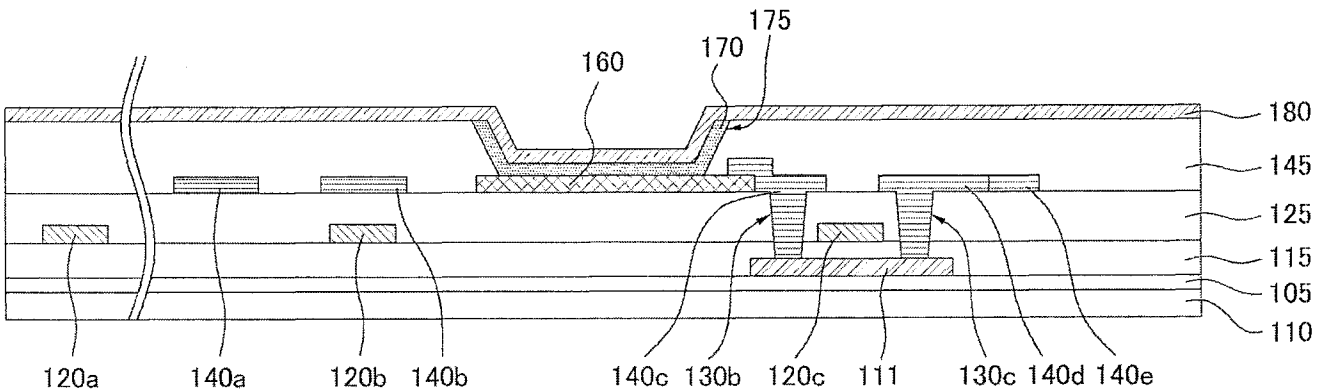

FIGS. 14, 15A and 15B show a structure of a subpixel of the organic light emitting device according to the exemplary embodiments. This structure includes a substrate 110 having a plurality of subpixel and non-subpixel areas. As shown, for instance, in FIG. 14, the subpixel area and the non-subpixel area may be defined by a scan line 120*a* that extends in one direction, a data line 140*a* that extends substantially perpendicular to the scan line 120*a*, and a power supply line 140*e* that extends substantially parallel to the data line 140*a*.

The subpixel area may include a switching thin film transistor T1 connected to the scan line 120*a* and the data line 140*a*, a capacitor Cst connected to the switching thin film transistor T1 and the power supply line 140*e*, and a driving thin film transistor T2 connected to the capacitor Cst and the power supply line 140*e*. The capacitor Cst may include a capacitor lower electrode 120*b* and a capacitor upper electrode 140*b*.

The subpixel area may also include an organic light emitting diode, which includes a first electrode 160 electrically connected to the driving thin film transistor T2, an emitting layer (not shown) on the first electrode 160, and a second electrode (not shown). The non-subpixel area may include the scan line 120*a*, the data line 140*a* and the power supply line 140*e*.

FIGS. 15A and 15B are cross-sectional views taken along line I-I' of FIG. 14.

As shown in FIG. 15A, a buffer layer 105 is positioned on the substrate 110. The buffer layer 105 prevents impurities (e.g., alkali ions discharged from the substrate 110) from being introduced during formation of the thin film transistor in a succeeding process. The buffer layer 105 may be selectively formed using silicon oxide ($SiO_2$), silicon nitride (SiNX), or using other materials. The substrate 110 may be formed of glass, plastic or metal.

A semiconductor layer 111 is positioned on the buffer layer 105. The semiconductor layer 111 may include amorphous silicon or crystallized polycrystalline silicon. The semiconductor layer 111 may include a source area and a drain area including p-type or n-type impurities. The semiconductor layer 111 may include a channel area in addition to the source area and the drain area.

A first insulating layer 115, which may be a gate insulating layer, is positioned on the semiconductor layer 111. The first insulating layer 115 may include a silicon oxide ($SiO_X$) layer, a silicon nitride ($SiN_X$) layer, or a multi-layered structure or a combination thereof.

A gate electrode 120*c* is positioned on the first insulating layer 115 in a given area of the semiconductor layer 111, e.g., at a location corresponding to the channel area of the semiconductor layer 111 when impurities are doped. The scan line 120*a* and the capacitor lower electrode 120*b* may be positioned on the same formation layer as the gate electrode 120*c*.

The gate electrode 120*c* may be formed of any one selected from the group consisting of molybdenum (Mo), aluminum (Al), chromium (Cr), gold (Au), titanium (Ti), nickel (Ni), neodymium (Nd) and copper (Cu), or a combination thereof. The gate electrode 120*c* may have a multi-layered structure formed of Mo, Al, Cr, Au, Ti, Ni, Nd, or Cu, or a combination thereof. The gate electrode 120*c* may have a double-layered structure including Mo/Al—Nd or Mo/Al.

The scan line 120*a* may be formed of any one selected from the group consisting of Mo, Al, Cr, Au, Ti, Ni, Nd, or Cu, or a combination thereof. The scan line 120*a* may have a multi-layered structure formed of Mo, Al, Cr, Au, Ti, Ni, Nd, or Cu, or a combination thereof. The scan line 120*a* may have a double-layered structure including Mo/Al—Nd or Mo/Al.

A second insulating layer 125, which may be an interlayer insulating layer, is positioned on the substrate 110 on which the scan line 120*a*, the capacitor lower electrode 120*b* and the gate electrode 120*c* are positioned. The second insulating layer 125 may include a silicon oxide ($SiO_X$) layer, a silicon nitride ($SiN_X$) layer, or a multi-layered structure or a combination thereof.

Contact holes 130*b* and 130*c* are positioned inside the second insulating layer 125 and the first insulating layer 115 to expose a portion of the semiconductor layer 111.

A drain electrode 140*c* and a source electrode 140*d* are positioned in the subpixel area to be electrically connected to the semiconductor layer 111 through the contact holes 130*b* and 130*c* passing through the second insulating layer 125 and the first insulating layer 115.

The drain electrode 140*c* and the source electrode 140*d* may have a single-layered structure or a multi-layered structure. When the drain electrode 140*c* and the source electrode 140*d* have the single-layered structure, the drain electrode 140*c* and the source electrode 140*d* may be formed of Mo, Al, Cr, Au, Ti, Ni, Nd, or Cu, or a combination thereof.

When the drain electrode 140*c* and the source electrode 140*d* have the multi-layered structure, the drain electrode 140*c* and the source electrode 140*d* may have a double-layered structure including Mo/Al—Nd or a triple-layered structure including Mo/Al/Mo or Mo/Al—Nd/Mo.

The data line 140*a*, the capacitor upper electrode 140*b*, and the power supply line 140*e* may be positioned on the same formation layer as the drain electrode 140*c* and the source electrode 140*d*.

The data line 140*a* and the power supply line 140*e* positioned in the non-subpixel area may have a single-layered structure or a multi-layered structure. When the data line 140*a* and the power supply line 140*e* have the single-layered structure, the data line 140*a* and the power supply line 140*e* may be formed of Mo, Al, Cr, Au, Ti, Ni, Nd, or Cu, or a combination thereof.

When the data line 140*a* and the power supply line 140*e* have the multi-layered structure, the data line 140*a* and the power supply line 140*e* may have a double-layered structure including Mo/Al—Nd or a triple-layered structure including Mo/Al/Mo or Mo/Al—Nd/Mo. The data line 140*a* and the power supply line 140*e* may have a triple-layered structure including Mo/Al—Nd/Mo.

A third insulating layer 145 is positioned on the data line 140*a*, the capacitor upper electrode 104*b*, the drain electrode 140*c*, the source electrode 140*d*, and the power supply line 140*e*. The third insulating layer 145 may be a planarization layer for obviating the height difference of a lower structure. The third insulating layer 145 may be formed using a method such as spin on glass (SOG) obtained by coating an organic material such as polyimide, benzocyclobutene-based resin and acrylate in the liquid form and then hardening it. Further, an inorganic material such a silicone oxide may be used. Otherwise, the third insulating layer 145 may be a passivation layer, and may include a silicon oxide ($SiO_X$) layer, a silicon nitride ($SiN_X$) layer, or a multi-layered structure including a combination thereof.

A via hole 165 is positioned inside the third insulating layer 145 to expose any one of the source and drain electrodes 140*c* and 140*d*. The first electrode 160 is positioned on the third insulating layer 145 to be electrically connected to any one of the source and drain electrodes 140*c* and 140*d* via the via hole 165.

The first electrode 160 may be an anode electrode, and may be a transparent electrode or a reflection electrode. When the organic light emitting device has a bottom emission or dual emission structure, the first electrode 160 may be a transparent electrode formed of one of indium-tin-oxide (ITO), indium-zinc-oxide (IZO) and zinc oxide (ZnO). When the organic light emitting device has a top emission structure, the first electrode 160 may be a reflection electrode. In this case, a reflection layer formed of one of Al, Ag and Ni may be positioned under a layer formed of one of ITO, IZO and ZnO, and also the reflection layer formed of one of Al, Ag and Ni may be positioned between two layers formed of one of ITO, IZO and ZnO.

A fourth insulating layer 155 including an opening 175 is positioned on the first electrode 160. The opening 175 provides electrical insulation between the neighboring first electrodes 160 and exposes a portion of the first electrode 160. An emitting layer 170 is positioned on the first electrode 160 exposed by the opening 175.

A second electrode 180 is positioned on the emitting layer 170. The second electrode 180 may be a cathode electrode, and may be formed of Mg, Ca, Al and Ag having a low work function or a combination thereof.

When the organic light emitting device has a top emission or dual emission structure, the second electrode 180 may be thin enough to transmit light. When the organic light emitting device has a bottom emission structure, the second electrode 180 may be thick enough to reflect light.

The organic light emitting device according to the exemplary embodiment using a total of 7 masks was described as an example. The 7 masks may be used in a process for forming each of the semiconductor layer, the gate electrode (including the scan line and the capacitor lower electrode), the contact holes, the source and drain electrodes (including the data line, the power supply line and the capacitor upper electrode), the via holes, the first electrode, and the opening.

An example of how an organic light emitting device is formed using a total of 5 masks will now be given.

As shown in FIG. 15B, the buffer layer 105 is positioned on the substrate 100, and the semiconductor layer 111 is positioned on the buffer layer 105. The first insulating layer 115 is positioned on the semiconductor layer 111. The gate electrode 120*c*, the capacitor lower electrode 120*b*, and the scan line 120*a* are positioned on the first insulating layer 115. The second insulating layer 125 is positioned on the gate electrode 120*c*.

The first electrode 160 is positioned on the second insulating layer 125, and the contact holes 130*b* and 130*c* are positioned to expose the semiconductor layer 111. The first electrode 160 and the contact holes 130*b* and 130*c* may be simultaneously formed.

The source electrode 140*d*, the drain electrode 140*c*, the data line 140*a*, the capacitor upper electrode 140*b*, and the power supply line 140*e* are positioned on the second insulating layer 125. A portion of the drain electrode 140*c* may be positioned on the first electrode 160.

A pixel or subpixel definition layer or the third insulating layer 145, which may be a bank layer, is positioned on the substrate 110 on which the above-described structure is formed. The opening 175 is positioned on the third insulating layer 145 to expose the first electrode 160. The emitting layer 170 is positioned on the first electrode 160 exposed by the opening 175, and the second electrode 180 is positioned on the emitting layer 170.

The aforementioned organic light emitting device can be manufactured using a total of 5 masks. The 5 masks are used in a process for forming each of the semiconductor layer, the gate electrode (including the scan line and the capacitor lower electrode), the first electrode (including the contact holes), the source and drain electrodes (including the data line, the power supply line and the capacitor upper electrode), and the opening. Accordingly, the organic light emitting device according to the exemplary embodiment can reduce the manufacturing cost by a reduction in the number of masks and can improve the efficiency of mass production.

Various color image display methods may be implemented in the organic light emitting device such as described above. These methods will be described below with reference to FIGS. 16A to 16C.

Figure 16A:
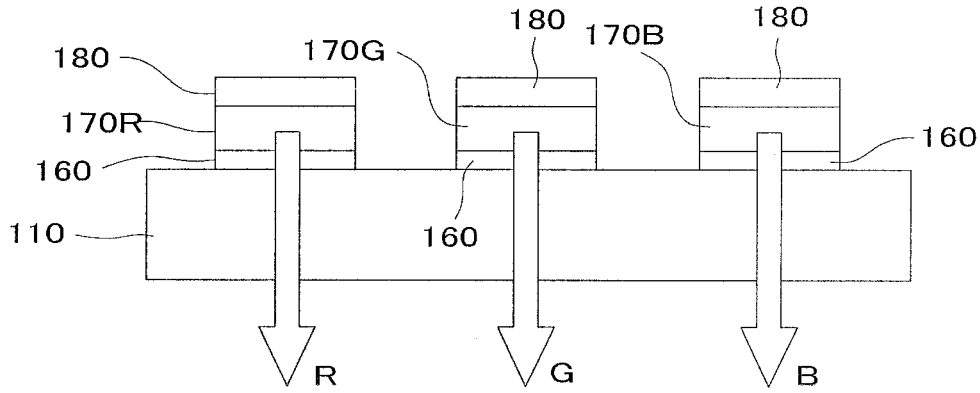
FIGS. 16A to 16C illustrate various implementations of a color image display method in the organic light emitting device according to the exemplary embodiments.
Figure 16B:
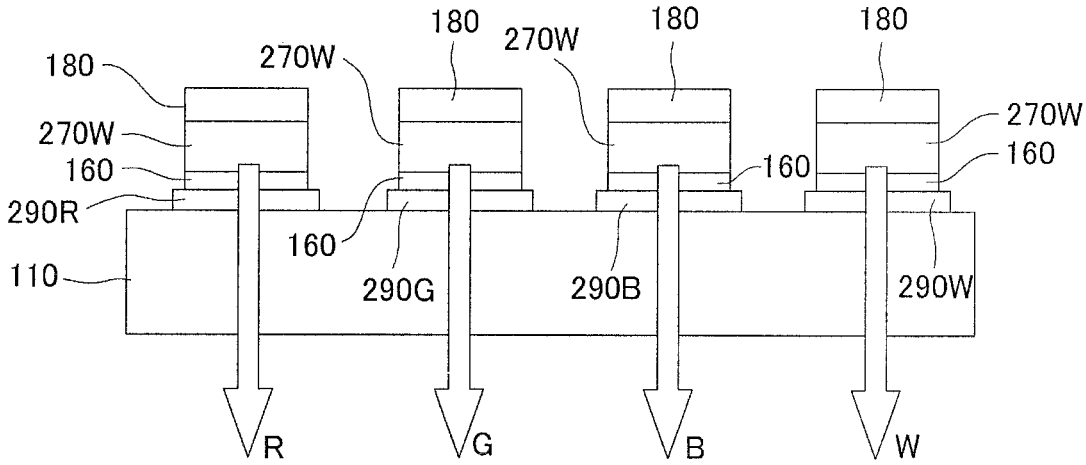
Figure 16C:
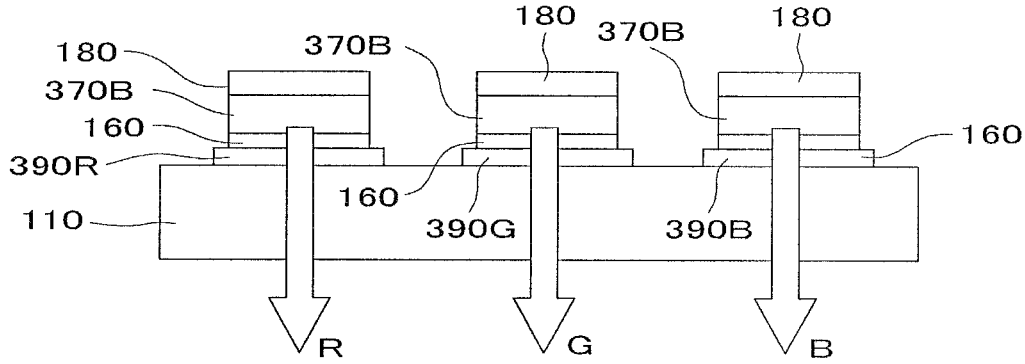

FIGS. 16A to 16C illustrate various implementations of a color image display method in the organic light emitting device according to the exemplary embodiments.

FIG. 16A illustrates a color image display method in an organic light emitting device separately including a red emitting layer 170R, a green emitting layer 170G and a blue emitting layer 170B which emit red, green and blue light, respectively.

The red, green and blue light produced by the red, green and blue emitting layers 170R, 170G and 170B is mixed to display a color image.

It may be understood in FIG. 16A that the red, green and blue emitting layers 170R, 170G and 170B each include an electron transporting layer, a hole transporting layer, and the like, on upper and lower portions thereof. It is possible to variously change the arrangement and the structure between the additional layers such as the electron transporting layer and the hole transporting layer and each of the red, green and blue emitting layers 170R, 170G and 170B.

FIG. 16B illustrates a color image display method in an organic light emitting device including a white emitting layer 270W, a red color filter 290R, a green color filter 290G, a blue color filter 290B, and a white color filter 290W.

As shown in FIG. 16B, the red color filter 290R, the green color filter 290G, the blue color filter 290B, and the white color filter 290W each transmit white light produced by the white emitting layer 270W to produce red light, green light, blue light, and white light. The red, green, blue, and white light is mixed to display a color image. The white color filter 290W may be removed depending on color sensitivity of the white light produced by the white emitting layer 270W and combination of the white light and the red, green and blue light.

While FIG. 16B has illustrated the color display method of four subpixels using combination of the red, green, blue, and white light, a color display method of three subpixels using combination of the red, green, and blue light may be used.

It may be understood in FIG. 16B that the white emitting layer 270W includes an electron transporting layer, a hole transporting layer, and the like, on upper and lower portions thereof. It is possible to variously change the arrangement and the structure between the additional layers such as the electron transporting layer and the hole transporting layer and the white emitting layer 270W.

FIG. 16C illustrates a color image display method in an organic light emitting device including a blue emitting layer 370B, a red color change medium 390R, a green color change medium 390G, a blue color change medium 390B.

As shown in FIG. 16C, the red color change medium 390R, the green color change medium 390G, and the blue color change medium 390B each transmit blue light produced by the blue emitting layer 370B to produce red light, green light and blue light. The red, green and blue light is mixed to display a color image.

The blue color change medium 390B may be removed depending on color sensitivity of the blue light produced by the blue emitting layer 370B and combination of the blue light and the red and green light.

It may be understood in FIG. 16C that the blue emitting layer 370B includes an electron transporting layer, a hole transporting layer, and the like, on upper and lower portions thereof. It is possible to variously change the arrangement and the structure between the additional layers such as the electron transporting layer and the hole transporting layer and the blue emitting layer 370B.

While FIGS. 16A and 16B have illustrated and described the organic light emitting device having a bottom emission structure, the exemplary embodiment is not limited thereto. The organic light emitting device according to the exemplary embodiment may have a top emission structure, and thus the structure of the organic light emitting device according to the exemplary embodiment may be changed depending on the top emission structure.

While FIGS. 16A to 16C have illustrated and described three kinds of color image display method, the exemplary embodiment is not limited thereto. The exemplary embodiment may use various kinds of color image display method whenever necessary.

Figure 17:
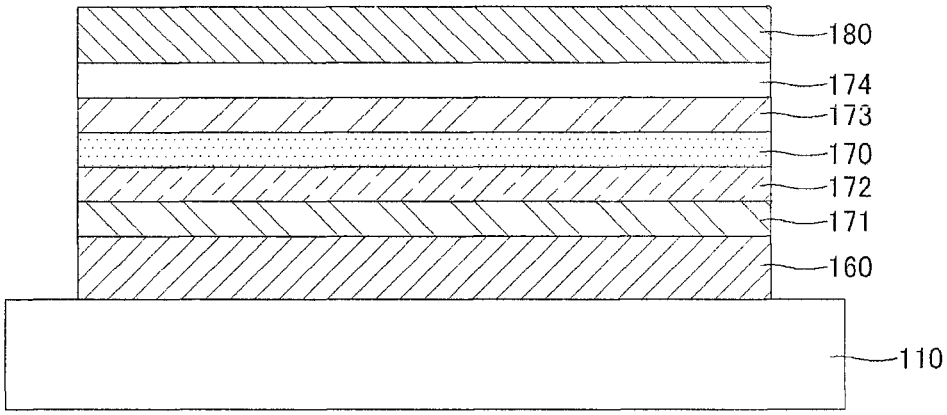
FIG. 17 is a cross-sectional view of the organic light emitting device according to the exemplary embodiments.

FIG. 17 is a cross-sectional view of the organic light emitting device according to the exemplary embodiments.

As shown in FIG. 17, the organic light emitting device according to the exemplary embodiment includes the substrate 110, the first electrode 160 positioned on the substrate 110, a hole injection layer 171 positioned on the first electrode 160, a hole transporting layer 172, an emitting layer 170, an electron transporting layer 173, an electron injection layer 174, and the second electrode 180 positioned on the electron injection layer 174.

The hole injection layer 171 may function to facilitate the injection of holes from the first electrode 160 to the emitting layer 170. The hole injection layer 171 may be formed of at least one selected from the group consisting of copper phthalocyanine (CuPc), PEDOT (poly(3,4)-ethylenedioxythiophene), polyaniline (PANI) and NPD (N,N-dinaphthyl-N,N'-diphenyl benzidine), but is not limited thereto. The hole injection layer 171 may be formed using an evaporation method or a spin coating method.

The hole transporting layer 172 functions to smoothly transport holes. The hole transporting layer 172 may be formed from at least one selected from the group consisting of NPD (N,N-dinaphthyl-N,N'-diphenyl benzidine), TPD (N,N'-bis-(3-methylphenyl)-N,N'-bis-(phenyl)-benzidine, s-TAD and MTDATA (4,4',4"-Tris(N-3-methylphenyl-N-phenyl-amino)-triphenylamine), but is not limited thereto. The hole transporting layer 172 may be formed using an evaporation method or a spin coating method.

The emitting layer 170 may be formed of a material capable of producing red, green, blue or white light such as, for example, a phosphorescence material or a fluorescence material.

In case that the emitting layer 170 emits red light, the emitting layer 170 includes a host material including carbazole biphenyl (CBP) or N,N-dicarbazolyl-3,5-benzene (mCP). Further, the emitting layer 170 may be formed of a phosphorescence material including a dopant material including any one selected from the group consisting of PIQIr (acac)(bis(1-phenylisoquinoline)acetylacetonate iridium), PQIr(acac)(bis(1-phenylquinoline)acetylacetonate iridium), PQIr(tris(1-phenylquinoline)iridium) and PtOEP(octaethylporphyrin platinum) or a fluorescence material including PBD:Eu(DBM)3(Phen) or Perylene, but is not limited thereto.

In case that the emitting layer 170 emits green light, the emitting layer 170 includes a host material including CBP or mCP. Further, the emitting layer 170 may be formed of a phosphorescence material including a dopant material including Ir(ppy)3(fac tris(2-phenylpyridine)iridium) or a fluorescence material including Alq3(tris(8-hydroxyquinolino)aluminum), but is not limited thereto.

In case that the emitting layer 170 emits blue light, the emitting layer 170 includes a host material including CBP or mCP. Further, the emitting layer 170 may be formed of a phosphorescence material including a dopant material including (4,6-F2 ppy)2Irpic or a fluorescence material including any one selected from the group consisting of spiro-DPVBi, spiro-6P, distyryl-benzene (DSB), distyryl-arylene (DSA), PFO-based polymers, PPV-based polymers and a combination thereof, but is not limited thereto.

The electron transporting layer 173 functions to facilitate the transportation of electrons. The electron transporting layer 173 may be formed of at least one selected from the group consisting of Alq3(tris(8-hydroxyquinolino)aluminum, PBD, TAZ, spiro-PBD, BAlq, and SAlq, but is not limited thereto. The electron transporting layer 173 may be formed using an evaporation method or a spin coating method.

The electron transporting layer 173 can also function to prevent holes, which are injected from the first electrode 160 and then pass through the emitting layer 170, from moving to the second electrode 180. In other words, the electron transporting layer 173 serves as a hole stop layer, which facilitates the coupling of holes and electrons in the emitting layer 170.

The electron injection layer 174 functions to facilitate the injection of electrons. The electron injection layer 174 may be formed of Alq3(tris(8-hydroxyquinolino)aluminum), PBD, TAZ, spiro-PBD, BAlq or SAlq, but is not limited thereto.

The electron injection layer 174 may be formed of an organic material and an inorganic material forming the electron injection layer 174 through a vacuum evaporation method.

The hole injection layer 171 or the electron injection layer 174 may further include an inorganic material. The inorganic material may further include a metal compound. The metal compound may include alkali metal or alkaline earth metal.

The metal compound including the alkali metal or the alkaline earth metal may include at least one selected from the group consisting of LiQ, LiF, NaF, KF, RbF, CsF, FrF, $BeF_2$, $MgF_2$, $CaF_2$, $SrF_2$, $BaF_2$, and $RaF_2$, but is not limited thereto.

Thus, the inorganic material inside the electron injection layer 174 facilitates hopping of electrons injected from the second electrode 180 to the emitting layer 170, so that holes and electrons injected into the emitting layer 170 are balanced. Accordingly, emission efficiency can be improved.

Further, the inorganic material inside the hole injection layer 171 reduces the mobility of holes injected from the first electrode 160 to the emitting layer 170, so that holes and electrons injected into the emitting layer 170 are balanced. Accordingly, emission efficiency can be improved.

At least one of the electron injection layer 174, the electron transporting layer 173, the hole transporting layer 172, the hole injection layer 171 may be omitted.

Accordingly, when the current supplied to the monitor pixels is sampled by using the sample hold unit, the current flowing at the monitor pixels can be accurately acquired as voltage even when there is a change in the ground level or when noise is generated, in consideration of various conditions in terms of the sampled value or the efficiency, and the voltage to be supplied to the subpixels can be controlled based on the acquired voltage.

As described above, the organic light emitting device according to the exemplary embodiments has such advantages that the number of display memories required for driving in units of the subfield can be reduced, the efficiency of data transmission can be enhanced, and the fabrication cost can be reduced.

In addition, the sampling efficiency and accuracy of the monitor pixels can be increased.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. An organic light emitting device comprising:

a display unit including a plurality of subpixels;

a host memory unit that stores image data received from the outside by each frame;

a data adjusting unit that fetches the image data frame stored in the host memory unit by bits and converts the image data frame into a plurality of subfields, wherein each subfield has a gray level weight value for representing gray scales; and one display memory unit that stores the image data frame converted into the plurality of subfields by the data adjusting unit and then supplies the image data to the display unit as a display data signal, wherein when the data adjusting unit converts the frame into the plurality of subfields, the data adjusting unit adds at least one extra subfield to the plurality of subfields and inserts a black time into the at least one extra subfield, and wherein the at least one extra subfield with the black time is only positioned at a head portion or at an end portion of the frame.

2. The organic light emitting device of claim 1, wherein the data adjusting unit converts the frame into the plurality of subfields based on data corresponding to the image data frame, and adds one or more subfields during the conversion.

3. The organic light emitting device of claim 2, wherein the added subfields are positioned at a head portion or at an end portion of the one frame.

4. The organic light emitting device of claim 1, wherein the data adjusting unit includes a look-up table, and the black time is inserted into the added subfields by the look-up table.

5. The organic light emitting device of claim 1, wherein the data adjusting unit includes a subfield arranging unit, and the subfield arranging unit arranges the black time-inserted subfields so that the black time-inserted subfields are stored in the display memory unit.

6. The organic light emitting device of claim 1, wherein a length of the black time-inserted subfield section is substantially greater than 3% and equal to or less than 30% of the total length of the one frame section.

7. The organic light emitting device of claim 1, wherein the black time is inserted into two or more subfields.

8. The organic light emitting device of claim 1, wherein the plurality of subpixels each include an emitting layer, and at least one of the emitting layers includes a phosphorescence material.

* * * * *